US007703635B2

(12) United States Patent
Smith

(10) Patent No.: US 7,703,635 B2
(45) Date of Patent: Apr. 27, 2010

(54) MEMORABILIA CONTAINER

(76) Inventor: David Arnold Smith, 2835 Sunset Blvd., Houston, TX (US) 77005

( * ) Notice: Subject to any disclaimer, the term of this patent is extended or adjusted under 35 U.S.C. 154(b) by 245 days.

(21) Appl. No.: 11/460,897

(22) Filed: Jul. 28, 2006

(65) Prior Publication Data

US 2008/0041870 A1 Feb. 21, 2008

(51) Int. Cl.
*B65D 43/24* (2006.01)

(52) U.S. Cl. ..... 220/818; 220/826; 206/232

(58) Field of Classification Search ..... 220/819, 220/818, 817, 826, 832, 259.2, 256.1; 206/232, 206/472, 473
See application file for complete search history.

(56) References Cited

U.S. PATENT DOCUMENTS

| | | | | | |
|---|---|---|---|---|---|
| 1,655,341 | A | | 1/1928 | Snellgrove | |
| 1,883,793 | A | * | 10/1932 | Johnson | 132/300 |
| 1,933,894 | A | * | 11/1933 | Clink | 220/259.2 |
| 3,394,861 | A | * | 7/1968 | Truax | 229/120.07 |
| D272,546 | S | | 2/1984 | Holson | |
| 4,633,091 | A | * | 12/1986 | Kurasch et al. | 250/506.1 |
| 5,096,056 | A | | 3/1992 | Garcia | |
| 6,012,789 | A | | 1/2000 | Lai | |
| D431,188 | S | | 9/2000 | Monn | |
| D463,662 | S | | 10/2002 | Leiden | |
| 2005/0023335 | A1 | | 2/2005 | Rasmussen | |

* cited by examiner

*Primary Examiner*—Stephen Castellano
(74) *Attorney, Agent, or Firm*—Keeling Patents & Trademarks LLC; Kenneth A. Keeling; Melissa M. Martinez

(57) ABSTRACT

A memorabilia container includes a receptacle for the memorabilia. The receptacle has opposite, upstanding side walls and an upstanding rear wall joining the side walls. The side walls and the rear wall have respective upper edges. A side lid is hingedly connected to each side wall. The side lid hinges are attached to the side walls such that the side walls do not open beyond a predetermined angle. Each side lid has an interior surface, an exterior surface, and an outer edge. The side lids close together with their outer edges abutting. A rear lid is hingedly connected to the rear wall. The rear wall hinge is attached to the rear wall such that the rear wall does not open beyond a predetermined angle. The rear lid has an interior surface and an exterior surface. The rear lid closes first, and the side lids close together over the rear lid. Photograph retainers are mounted on interior surfaces of the side lids and the rear lid.

4 Claims, 5 Drawing Sheets

MEMORABILIA CONTAINER

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates generally to containers for memorabilia, and, more specifically, to a memorabilia container for displaying photographs when open.

2. Description of the Related Art

Keepsake containers of various types have been made for many years. For example, U.S. Pat. No. 1,655,341, issued to J. A. Snellgrove in 1928, discloses a memento novelty souvenir holder in the form of a book with a single hinged lid. The holder contains an accordion-like photograph holder.

U.S. Pat. No. 5,096,056, issued to Garcia, discloses a memento box having a single hinged lid and a partition matrix fitted within the box.

U.S. Pat. No. 6,012,789, issued to Kuo-Tsun Lai, discloses a mirror base of a vanity or jewel case having a single hinged lid. A pair of mirror doors is hingedly attached to the lid, and holds photos on their outer surfaces. The box contains a plurality of partitioned compartments.

U.S. Patent No. 2005/0023335 A1, issued to Rasmussen et al., discloses a packing box having hinged lids on opposite sides that fold inward toward each other. The embodiment shown in FIG. 4 has a single hinged lid.

U.S. Design Patent No. Des. 272,546, issued to Holson, discloses a book-like storage container for photographs having a single hinged lid, like a front book cover.

U.S. Design Pat. No. Des. 431,188, issued to Monn, discloses a jewelry display box having two hinged panels on opposite sides that fold together, overlapping one another.

U.S. Design Pat. No. D463,662 S, issued to Leiden et al., discloses another book-like memorabilia box having a single hinged lid opening to the side or the top. However, there remains a need in the art for a memorabilia container for displaying memorable photographs when the user is accessing the container receptacle.

BRIEF SUMMARY OF THE INVENTION

According to one embodiment of the invention, a memorabilia container includes a box-like receptacle for the memorabilia. The receptacle has opposite, upstanding side walls and an upstanding rear wall joining the side walls. The side walls and the rear wall have respective upper edges. A side lid is hingedly connected to each side wall. The side lid hinges are attached to the side walls such that the side lids are prevented from opening beyond a predetermined angle. In one embodiment, the side lid hinges may be attached to the side walls below or at the upper edges of the side walls. In an exemplary embodiment, the side lid hinges are attached to the upper edge of the side wall.

Each side lid has an interior surface, an exterior surface, and an outer edge. The side lids close together with their outer edges abutting. A rear lid is hingedly connected to the rear wall. The rear wall lid hinge is attached to the rear wall so that the hinge and/or the rear wall's upper edge stops the rear lid from opening beyond a predetermined angle. In one embodiment, the rear wall's hinge is attached to the rear wall below or at the upper edge of the rear wall, or alternatively, the hinge may be attached on the upper edge of the rear wall. The rear lid has an interior surface and an exterior surface. The rear lid closes first, and the side lids close together over the rear lid. Photograph retainers are mounted on the interior surfaces of the side lids and the rear lid.

Accordingly, it is an object of the present invention to provide a memorabilia container that displays memorable photographs when the user is accessing the container receptacle. Other objects of the invention are apparent from the following description, the claims set forth below, and the accompanying drawings.

BRIEF DESCRIPTION OF THE DRAWINGS

For a more complete understanding of the present invention and the advantages thereof, reference is now made to the following Detailed Description of an Example Embodiment of the Invention, taken in conjunction with the accompanying drawings, in which.

DESCRIPTION OF AN EXAMPLE EMBODIMENT OF THE INVENTION

Figure 1:
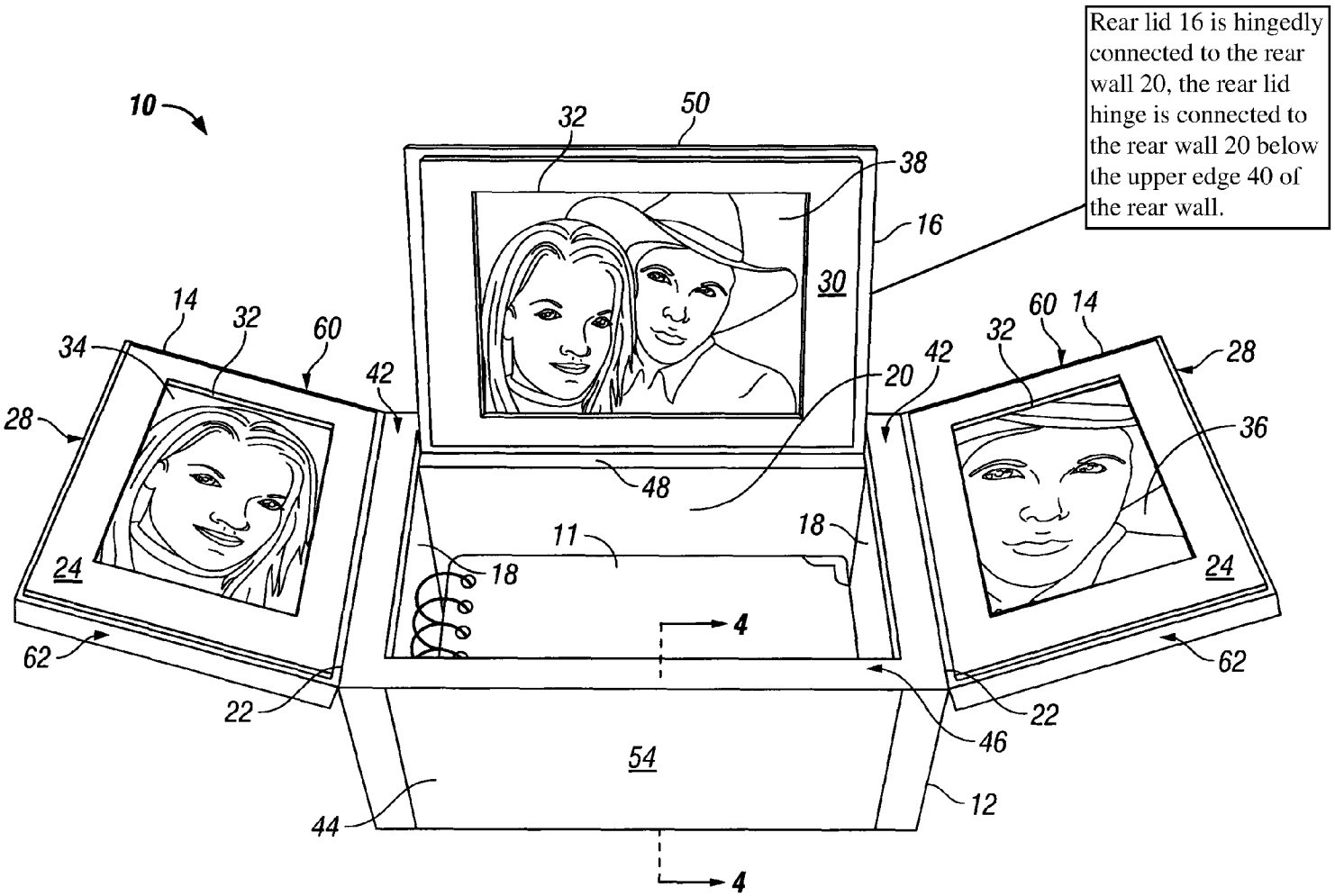
FIG. 1 is a perspective view of a memorabilia container of the present invention with its side and rear lids open.
Figure 2:
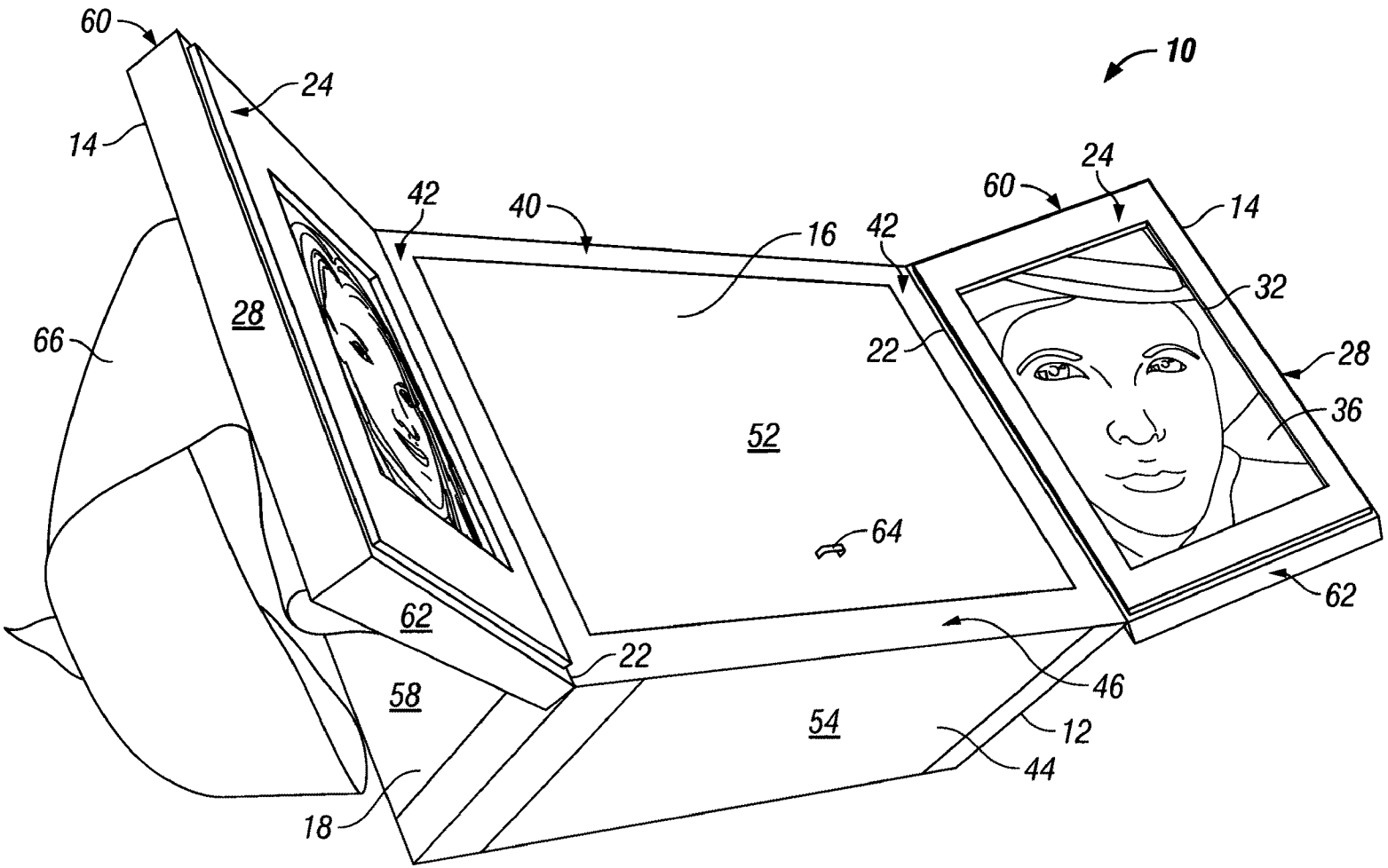
FIG. 2 shows the memorabilia container of FIG. 1 with its rear lid closed and its side lids open.
Figure 3:
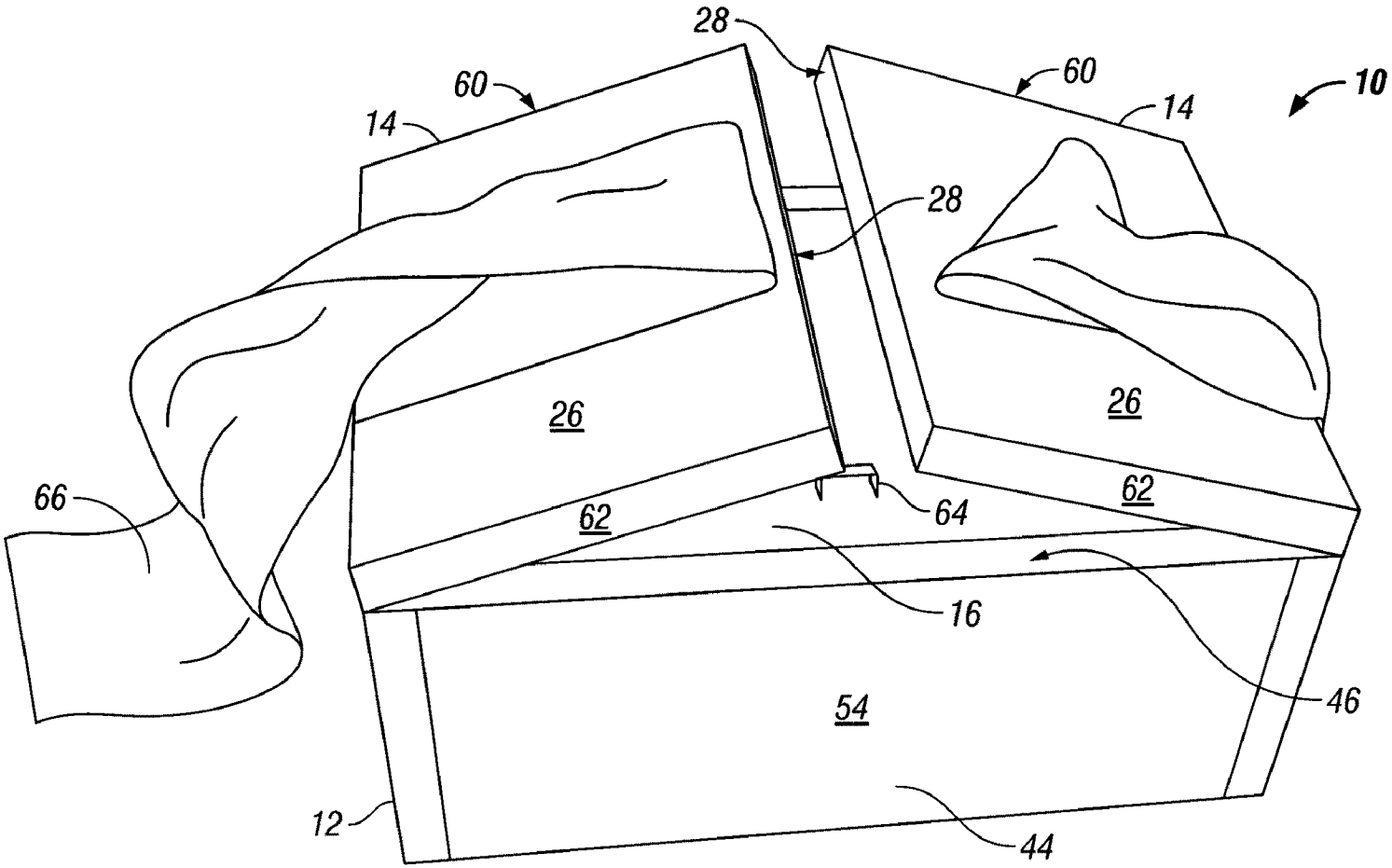
FIG. 3 shows the memorabilia container of FIG. 1 with its rear lid closed and its side lids substantially closed.

The invention and its advantages are best understood by referring to the drawings, like numerals being used for like and corresponding parts of the various drawings. In FIGS. 1-3 there is shown, in perspective view, a memorabilia container, generally designated 10, according to an example embodiment of the invention. Referring to FIG. 1, memorabilia container 10 includes receptacle 12, a pair of side lids 14, and a rear lid 16. In the example embodiment illustrated, memorabilia container 10 is intended to memorialize a couple's wedding and store their wedding related memorabilia, such as a photograph album 11, videotapes, or CDs (not illustrated). In an exemplary embodiment, in FIG. 1, one side lid 14 holds a photograph 34 of the bride, and the other side lid 14 holds a photograph 36 of the groom. Rear lid 16 holds a photograph 38 of the bride and groom together. Side lids 14 and rear lid 16 open to only a limited, predetermined angle for best viewing the photographs 34, 36, and 38 when the lids 14 and 16 are in their open positions.

FIG. 2 shows memorabilia container 10 with its rear lid 16 closed and side lids 14 open. Hinges along the upper edge 40 of the rear wall 20 attach the rear wall to the rear lid 16. In operation, rear lid 16 closes first, then side lids 14 close together over rear lid 16. FIG. 3 shows memorabilia container 10 with its side lids 14 substantially closed over its rear lid 16.

Figure 3A:
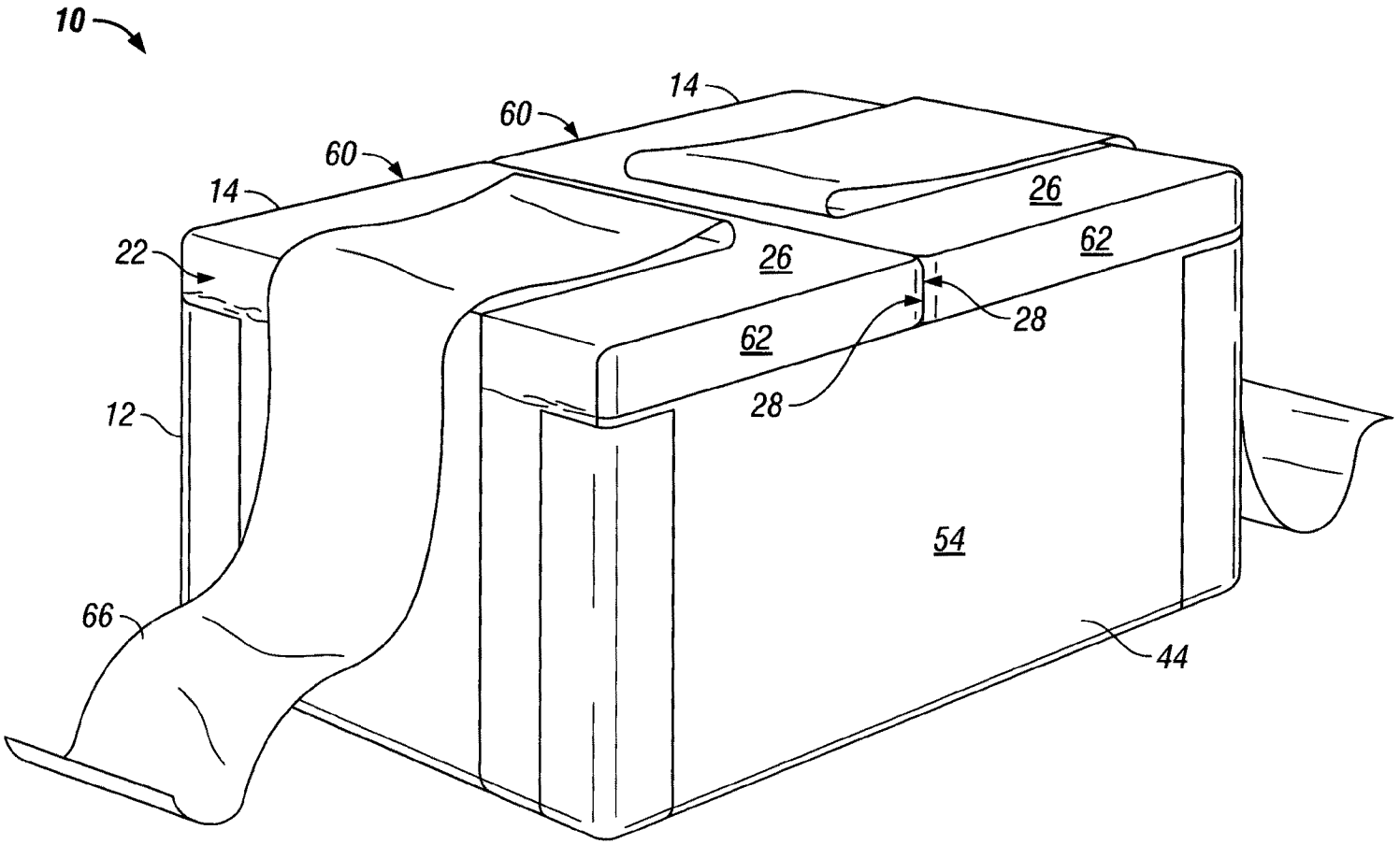
FIG. 3A shows the memorabilia container of FIG. 1 with its side lids in their fully closed position.

Referring to FIG. 1, receptacle 12 has opposite, upstanding side walls 18 and an upstanding rear wall 20 joining side walls 18. Side lids 14 are hingedly connected to respective side walls 18 along an inner edge 22 of side lids 14. Side lids 14 open to only a predetermined angle for best viewing photographs 34 and 36 mounted thereon. Each side lid 14 has an interior surface 24, an exterior surface 26, and an outer edge 28. As seen in FIGS. 3 and 3A, side lids 14 close together with their outer edges 28 abutting one another.

Referring to FIGS. 1 and 2, rear lid 16 has an interior surface 30 and an exterior surface 52. Photograph retainers 32 are mounted on the interior surfaces 24 of side lids 14 and on the interior surface 30 of rear lid 16. Rear lid 16 is hingedly connected to rear wall 20 of receptacle 12. The hinge is formed at the connection between the upper edge 40 of the rear wall 20 and the base of the rear lid 16. In an exemplary embodiment, the hinge is attached such that the upper edge 40 of the rear wall 20 substantially stops rear lid 16 from opening beyond the predetermined angle for viewing photograph 38 mounted on the interior surface 30 of rear lid 16. In the illustrated embodiment, rear lid 16 opens to approximately 100 degrees from its closed position.

Side walls 18 have upper edges 42. The hinges of side lids 14 connect the side walls 18 to the side lids 14 along the inner edge 22 of the side lids 14 the upper edges 42 stop the side lids 14 from opening beyond a predetermined angle for viewing photographs 34 and 36 mounted on their interior surfaces 24.

Figure 4:
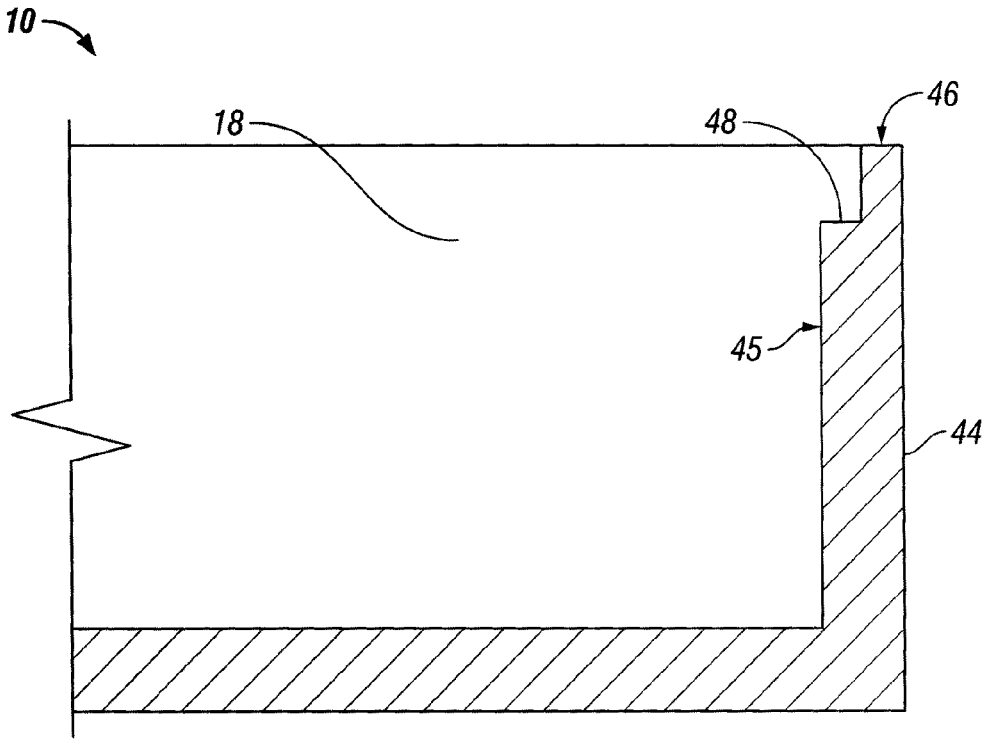
FIG. 4 is a partial cross-sectional view of the container, taken along line 4-4 in Figure.

Referring to FIGS. 1 and 4, receptacle 12 includes an upstanding front wall 44 opposite its rear wall 20. Front wall 44 has an interior surface 45, an upper edge 46, and an interior ledge 48 spaced below its upper edge 46. The rear wall 20 also contains an interior ledge 48. The interior ledges 48 support the outer edge 50 of rear lid 16 when it is closed over receptacle 12. When rear lid 16 is closed, its exterior surface 52 is flush with the upper edges 42 of side walls 18 and with upper edges 40 and 46 of rear wall 20 and front wall 44, respectfully, of receptacle 12.

Side lids 14 have top edges 60 and bottom edges 62. When side lids 14 are closed, their top edges 60, bottom edges 62, and inner edges 22 are flush with the exterior surface of the rear wall 44, exterior surface 54 of front wall 44, and exterior surfaces 58 of side walls 18, respectively, of receptacle 12.

Referring to FIGS. 2 and 3, ring 64 is attached to the exterior surface 52 of rear lid 16 near its outer edge for manually lifting the rear lid 16 from its closed position. In the illustrated embodiment, ring 64 is gold in color and resembles a wedding ring. In an alternative embodiment, ribbon 66 wraps and extends around the exterior of receptacle 12 and of side lids 14. The free ends of ribbon 66 are tied together over side lids 14 for retaining memorabilia container 10 closed when it is being stored.

In one embodiment, the hinges in relation to the side walls 14 are attached to the side walls 18 below their upper edges 42, so that the side wall upper edges 42 stop the side lids 14 from opening beyond a predetermined angle for viewing photographs 34 and 36 mounted on their interior surfaces 24.

In an exemplary embodiment, rear lid 16 is hingedly connected to rear wall 20 of receptacle 12. The hinge of rear lid 16 is attached to rear wall 20 below the upper edge 40 and the base of the rear lid 16 of rear wall 20, so that the rear wall upper edge 40 stops rear lid 16 from opening beyond the predetermined angle for viewing photograph 38 mounted on the interior surface 30 of rear lid 16.

In one embodiment, side lids 14, rear lid 16, and receptacle 12 are made from plastic or wood, and are padded to give them a soft and cushioned appearance. The padding is wrapped with a decorative fabric such as satin or silk.

In one embodiment of the invention (not illustrated), rear lid 16 activates an electric switch so that when rear lid 16 is opened, a battery operated device plays wedding music or an audio recording of the couple reciting their wedding vows. The closing of rear lid 16 deactivates the device to stop the playing of the music or audio recording.

In another embodiment of the invention (not illustrated), the interior of memorabilia container 10 has a false bottom which provides a hidden storage area for small gifts, such as a ring, earrings, necklace, bracelet, or watch. In this embodiment, container 10 can be a "gift that keeps on giving."

The memorabilia container of the present invention, and many of its intended advantages, will be understood from the foregoing description of an example embodiment, and it will be apparent that, although the invention and its advantages have been described in detail, various changes, substitutions, and alterations may be made in the manner, procedure, and details thereof without departing from the spirit and scope of the invention, as defined by the appended claims, or sacrificing any of its material advantages, the forms hereinbefore described being merely an exemplary embodiment thereof.

What is claimed is:

1. A memorabilia container, which comprises:

a receptacle for the memorabilia, the receptacle having opposite, upstanding side walls and an upstanding rear wall joining the side walls, the side walls and the rear wall having respective upper edges;

a side lid hingedly connected to each side wall along an inner edge of the side lid, so that the side lid does not open beyond a predetermined angle, each side lid having an interior surface, an exterior surface, and an outer edge, the side lids closing together with their outer edges abutting;

a rear lid hingedly connected to the rear wall, the rear lid having an interior surface and an exterior surface, and wherein the rear lid closes first, and the side lids close together over the rear lid;

photograph retainers mounted on the interior surface of each side lid and the rear lid;

wherein the surface of the photograph retainers of the respective side lids contact the exterior surface of the rear lid when the side lids are closed; and wherein the rear lid hinge is connected to the rear wall below the upper edge of the rear wall such that the rear wall upper edge stops the rear lid from opening beyond a predetermined angle.

2. The container of claim 1, further including an upstanding front wall opposite the rear wall, the front wall having an interior surface, an upper edge, and an interior ledge proximate the upper edge, whereby the interior ledge supports a portion of the rear lid in the closed position.

3. The container of claim 2, wherein the side walls and rear wall have upper edges, and wherein the exterior surface of the rear lid is flush with the upper edges of the side walls and the upper edges of the front and rear walls when it is closed, and wherein the front wall, rear wall, and side walls have exterior surfaces, the side lids each have top and bottom edges, and wherein the top, bottom, and inner edges of the side lids are flush with the exterior surfaces of the rear wall, the front wall, and the side wall, respectfully, when the side lids are closed.

4. The container of claim 1, further including a ring attached to at least one of the rear lid and the side lids for manually lifting the lid from its closed position.

* * * * *

UNITED STATES PATENT AND TRADEMARK OFFICE

CERTIFICATE OF CORRECTION

PATENT NO. : 7,703,635 B2
APPLICATION NO. : 11/460897
DATED : April 27, 2010
INVENTOR(S) : David Arnold Smith It is certified that error appears in the above-identified patent and that said Letters Patent is hereby corrected as shown below:

Title Page; item (76);

Replace the address of the inventor with the following:

Inventor: David Arnold Smith, 2635 Sunset Blvd., Houston, TX (US) 77005

Signed and Sealed this
Fifteenth Day of February, 2011

David J. Kappos

David J. Kappos
*Director of the United States Patent and Trademark Office*